US007011231B2

(12) United States Patent
Boykin et al.

(10) Patent No.: US 7,011,231 B2
(45) Date of Patent: Mar. 14, 2006

(54) SIDE-ACCESS FRONT ASSEMBLIES FOR CUP DISPENSER, AND CUP DISPENSERS WITH SAME

(76) Inventors: James Oliver Boykin, 22380 NE. 112th Ter., Ft. McCoy, FL (US) 32134; Lynne Kay Boykin, 22380 NE. 112th Ter., Ft. McCoy, FL (US) 32134

( * ) Notice: Subject to any disclaimer, the term of this patent is extended or adjusted under 35 U.S.C. 154(b) by 17 days.

(21) Appl. No.: 10/683,601

(22) Filed: Oct. 10, 2003

(65) Prior Publication Data

US 2005/0077314 A1 Apr. 14, 2005

(51) Int. Cl.
*A47F 1/04* (2006.01)

(52) U.S. Cl. ..... 221/303; 221/307; 221/310

(58) Field of Classification Search ..... 221/303, 221/304, 307, 310; 312/43
See application file for complete search history.

(56) References Cited

U.S. PATENT DOCUMENTS

| | | | | |
|---|---|---|---|---|
| 1,131,255 | A | 3/1915 | Luellen | |
| 1,336,469 | A * | 4/1920 | Luellen | 221/310 |
| 3,211,329 | A | 10/1965 | Boyd | |
| 3,420,406 | A | 1/1969 | Granam | |
| 3,435,987 | A | 4/1969 | Saunders et al. | |
| 4,033,478 | A | 7/1977 | House | |
| 4,079,858 | A | 3/1978 | Fuss | |
| 4,234,101 | A | 11/1980 | Pastore | |
| 4,298,142 | A | 11/1981 | Stanley | |
| 4,658,983 | A | 4/1987 | Suttles | |
| 4,858,783 | A * | 8/1989 | Mayfield, III | 221/59 |
| 4,881,660 | A | 11/1989 | Suttles | |
| 5,012,952 | A | 5/1991 | Franz | |
| 5,199,601 | A | 4/1993 | Roethel | |
| 5,222,628 | A * | 6/1993 | Roethel | 221/307 |
| 5,709,316 | A | 1/1998 | Jolly et al. | |
| 5,884,803 | A | 3/1999 | Vine | |
| 6,003,724 | A | 12/1999 | Collins et al. | |
| 6,199,723 | B1 * | 3/2001 | Collins et al. | 221/307 |
| 6,398,072 | B1 * | 6/2002 | Nitta et al. | 221/307 |
| 6,471,092 | B1 | 10/2002 | Thompson | |
| 2001/0032860 | A1 * | 10/2001 | Roethel et al. | 221/282 |

OTHER PUBLICATIONS

San Jamar International Dispenser Specialists, 1999-2000 Product Catalog, catalog cover page and pp. 12-15.

* cited by examiner

*Primary Examiner*—David H. Bollinger
(74) *Attorney, Agent, or Firm*—Joseph Fischer; Beusse, Brownlee, Wolter, Mora & Maire, P.A.

(57) ABSTRACT

A cup-dispensing apparatus and system is disclosed that utilizes a front piece that comprises a side-access port into which is reversibly inserted a cup-dispensing insert. This front piece/cup-dispensing insert assembly may be manufactured separately from or integral with other components of a cup-dispensing unit. The cup-dispensing unit comprises a flexible gasket or other cup retaining means that retains the last of a stack of cups in place, against an opposing cup-advancing force developed within the cup-dispensing unit. The use of the side-access port provides for improved performance, maintenance, repair, and aesthetic qualities.

11 Claims, 6 Drawing Sheets

SIDE-ACCESS FRONT ASSEMBLIES FOR CUP DISPENSER, AND CUP DISPENSERS WITH SAME

FIELD OF THE INVENTION

This invention relates to dispensers for articles such as beverage and soup cups disposed within a container, typically in a nested stacked arrangement, and dislodged or separated therefrom individually, as by transient distortion of the article being dispensed. In preferred embodiments, the present invention is directed to an apparatus to dispense disposable beverage cups, and more particularly, is adaptable to use with different size cups.

BACKGROUND OF THE INVENTION

The present invention relates to dispensing apparatuses, and to subcombinations of such dispensing apparatuses, that are useful in the dispensing of cylindrical or frusto-conical articles, and particularly for the dispensing of disposable cups that are arranged in a nested and stacked orientation in the dispensing apparatus. The apparatuses of present invention provide for superior reliability and performance, and superior ease of operation and maintenance, for dispensing stacked beverage cups and the like.

Various designs and principles of food service dispensers, particularly for dispensing beverage cups and the like, are known in the art. With regard to a beverage cup dispenser (which for purposes of this application includes dispensers for bowls and other stackable, generally round and deformable food containers), the most common dispenser types each have their respective advantages and disadvantages. For most or all cup dispenser designs in the art field, the part(s) that retain the stack of cups in the dispenser, and from which a single cup is removed by a user in need thereof, is/are installed, repaired, maintained, and changed out from via the front face of the dispenser apparatus. When certain components of such systems wear out or fail, or otherwise break, or are tampered with, this can result in improper operation of the cup dispenser. In some situations this is readily apparent to a passing customer in a store in which the cup dispenser is placed. As described herein, the present invention differs from such front-access designs by employing a subcombination front assembly that comprises a side-access cup-dispensing insert. At a minimum, the present invention provides for easier change-out of worn or broken components that some cup dispensers now in the marketplace.

Despite their differences, the various designs of cup dispensers attempt to satisfy the following standard operational criteria:

1. retain a quantity of cups in a stacked orientation;
2. employ a means to retain a "next cup to be dispensed" cup positioned at the end of the stack until a force is applied by a user in need thereof to take that cup;
3. whether by gravity or other means (i.e., a spring), maintain a force on the stack sufficient to move the next cup in the stack in the position of the "next cup to be dispensed" cup after a cup is removed by a user; and
4. provide access means to components of the dispenser for change-out of components that determine cup diameter, size, etc., for cleaning, and for general maintenance.

While not intending to disparage the efforts of other manufacturers, or their products now on the market, the inventors of the present invention have recognized that various designs of various manufacturers do not, in certain situations, reliably and consistently meet all of the above operational criteria.

Specific examples of prior art drinking cup dispensers are found in the following references: U.S. Pat. Nos. 3,420,406; 3,435,987; 4,234,101; 4,298,142; 4,658,983; 4,858,783; 4,881,660; 5,012,952; 5,884,803; 6,398,072; and 6,471,092. None of these references, however, teach the use of a front piece for a cup dispenser where that front piece is designed to accommodate a cup-dispensing insert that is assembled into and removed from the front piece via a side access port. This design of cup dispensing creates an exterior front face of the dispenser that is smooth, uninterrupted, with no added external locking rings, decorative or mechanical, needed to enhance function of dispensing cups.

All patents, patent applications and publications discussed or cited herein are incorporated by reference to the same extent as if each individual publication or patent application was specifically and individually set forth in its entirety.

SUMMARY OF THE INVENTION

The present invention provides beverage cup dispensing apparatuses all of which have a front assembly, the front assembly comprising a cup-retaining means positioned on a cup-dispensing insert, where the cup-retaining insert is reversibly engageable with and removable from its operational position via an access port positioned on a side of the front portion of the dispensing apparatus.

In certain embodiments of the apparatus of the present invention, the cup-dispensing insert is comprised of a flat silicone rubber gasket extending across the interior span of the front opening of a beverage dispensing apparatus for which the cup-dispensing insert is intended. This cup-dispensing insert also is comprised of a gasket frame composed of a material more resilient, yet nonetheless having sufficient flexibility for repeated insertions and removals. The gasket frame is adhered to the flat silicone rubber gasket in order to form a functional cup-dispensing insert. In certain embodiments the gasket frame is comprised of two substantially identically shaped pieces that sandwich the flat silicone rubber gasket, where these three pieces are attached together by sewing with nylon thread.

In certain embodiments of the apparatus of the present invention, a locking button mechanism is designed into the cup-dispensing insert and the front frame or front piece with which the cup-dispensing insert is designed to operate. This locking button mechanism reversibly retains the front plate in its intended, designed operational position, and is released upon a sufficient determined force for removal of the front frame. In other embodiments other retaining or locking means are used instead of the locking button mechanism.

In certain embodiments of the apparatus of the present invention, the front piece that slidably receives the cup-dispensing insert is integral with, or unitary with, the body of a beverage dispensing apparatus. In other embodiments the front piece is manufactured and sold independently of or separate from other components (i.e., tube to contain stacked cups) of a beverage dispensing apparatus. In the latter cases, the front portion is attached to a selected body (i.e., tube to contain stacked cups) of a beverage dispensing apparatus, and, upon insertion of a desired cup-dispensing insert, such assembly of components then is functional as a beverage dispensing apparatus.

Further, from an aesthetic and cleaning perspective, the design of cup dispensing subcombinations and units of the present invention provide an exterior front face of the dispenser that is smooth and largely uninterrupted, without the need for external locking rings or other mechanical components to the front face.

Still other aspects, objects, advantages, and/or features of the present invention will become readily apparent by those skilled in the art from a review of the following detailed description and drawings. The detailed description shows and describes certain embodiments of the present invention, including, simply by way of illustration, the best mode contemplated of carrying out the present invention. As will be realized, the present invention is capable of other and different embodiments and its several details are capable of modifications in various obvious respects, without departing from the invention. Accordingly, the drawings and description are illustrative in nature and not restrictive.

BRIEF DESCRIPTION OF THE FIGURES

FIG. 2C includes a cut-away section to show the internal helical spring and cup retainer that provide and transfer, respectively, cup advancing force to stacked cups.

DETAILED DESCRIPTION OF THE INVENTION

Figure 1B:
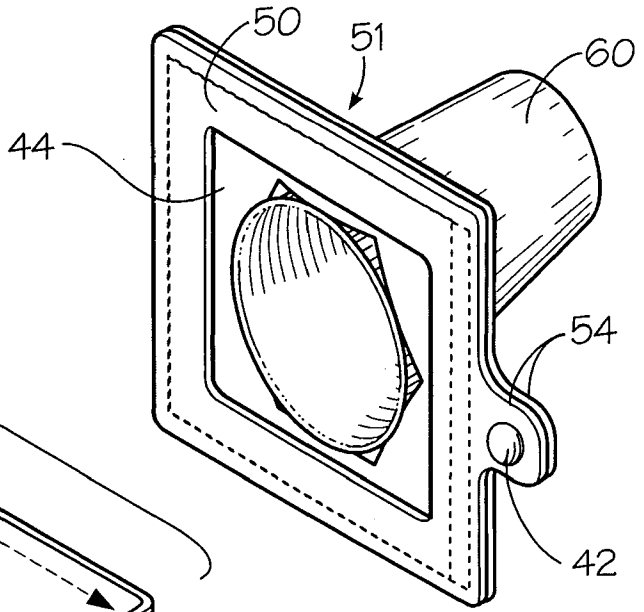
FIGS. 1A–C provide exploded and perspective views of one embodiment of a front assembly of the present invention, comprising a front piece and a cup-dispensing insert.

As used herein, including the claims, the term "cup" is taken to mean any container designed to hold a beverage or other liquid that is shaped to be stackable in a nested orientation. The term "cup" includes, but is not limited to, a substantially paper or plastic truncated frusto-conical shaped receptacle suitable to contain liquids having conical sides in sealed communication with a planar bottom piece, and having an open top into which liquids are dispensed and from which liquids are drunken. Further, "cup" as used herein may also include non-conical shaped receptacle, such as, without being limited, a truncated hexagonal or octagonal soup bowl that comprises sufficient angular inclination along its sides so as to provide for nested stacking. Typically the cups dispensed in the present invention are disposable.

As used herein, including the claims, the term "cup-advancing force" is taken to mean any physical force that is exerted on a stack of nested cups that is within a range of forces that advances the stack of nested cups in a dispenser to advance the next cup forward to a user in need thereof. Typical means to provide a cup-advancing force include, but are not limited to, a helical spring, gravity, and the combination of gravity and a helical spring.

As used herein, including the claims, the terms "side," "side-access," "side-accessed" and the like, when used to describe a port or slot of the present invention, are not to be taken to preclude orientating a cup dispenser of the present invention from having the access port for the front piece to the bottom, to the top, or at an any angle between. For instance, considering one quadrant, 90 and 180 degrees (with zero degrees representing straight up vertical), the axis of the access port may lie along the tangent of any angle between 90 and 180 degrees, inclusive. That is, depending on a particular layout of the cup dispensers of the present invention, the front piece access ports may be facing downward, upward, laterally to one side or the other, or at any diagonal angle.

As used herein, including the claims, the terms "plurality of nested articles" and "plurality of nested cups" means at least two such articles or cups that can be arranged in a stack.

As used herein, including the claims, the term "front piece" is taken to mean either the front piece as a component of the cup-dispensing insert/front piece combination described and claimed herein, as an independent front piece, having a side access port to suitably engage a cup-dispensing insert, or having the properties of the front piece of the cup-dispensing insert/front piece combination described and claimed herein but being integrally associated with a cup-dispensing unit that additionally comprises other components of a cup dispenser.

As used herein, including the claims, the term "centrally positioned hole" is taken to mean an opening, hole or void that is positioned away from, and does not transect, the outside perimeter of the frame in which it is positioned. A "centrally positioned hole" as used herein includes holes that are positioned to have as their center the geometrically determined center of the rectangle, square, or other shape of the component in which such hole is positioned. A "centrally positioned hole" as used herein also includes holes that are positioned such that each of their centers is offset from such geometrically determined center of the component in which such hole is positioned, so long as the respective hole does not transect a line that forms the perimeter of the frame (or analogous aspect or component) in which such hole is positioned.

Other definitions are provided below as appropriate.

Generally, the present invention advances the art of cup dispensers by providing an apparatus comprising a side-port-accessible front-piece for a cup dispenser. Reversibly insertable into the front-piece, via the side port, is a cup-dispensing insert. Typically, any of a number of mechanical means is utilized to secure the insert in its operational position in the front-piece during operation. However, in many embodiments such mechanical means provide for ready and easy removal of the insert for cleaning, for repair and maintenance, and for cleaning.

More particularly, in certain embodiments of the present invention, the cup-dispensing insert is comprised of a flexible gasket having a hole formed into it to accommodate the retention and passage of a particularly sized cup. The gasket is given rigidity at its edges by attachment to a resilient frame that is sized to slide into the side port of a front piece. A nested stack of such cups is presented from behind the front-piece, and sufficient cup-advancing force is effectuated to advance a "next cup" of the stack to the hole of the gasket after a user removes the first, or exposed, cup. The gasket and the resilient frame are attached to one another by any of standard means known in the art. As noted above, for one configuration, the gasket frame is comprised of two substantially identically shaped pieces that sandwich the flat silicone rubber gasket, and these three pieces are attached together by sewing with nylon thread. It has been found that sewing these parts together with nylon thread provides a suitable degree of flexibility and resiliency when using a silicon rubber gasket and a polycarbonate plastic frame.

In other embodiments, the cup-dispensing insert is formed as an integral unit, such as by co-extrusion injection molding. In such process at least two types of plastic are co-injected, with a more rigid, or resilient plastic being injected to the peripheral regions of the mold, and a more pliable, flexible plastic injected to form a central region which will include a hole sized for passage of cups in the cup dispenser apparatus of the present invention.

In the descriptions and referenced figures, no attempt is made to show the structural details of the invention, whether the subcombinations or the entire cup dispensers, in more detail than is necessary for a fundamental understanding of the invention by one of ordinary skill in the art. The description herein, together with the drawings, make apparent to those skilled in the art how the several forms of the invention may be embodied in practice.

Figure 1A:
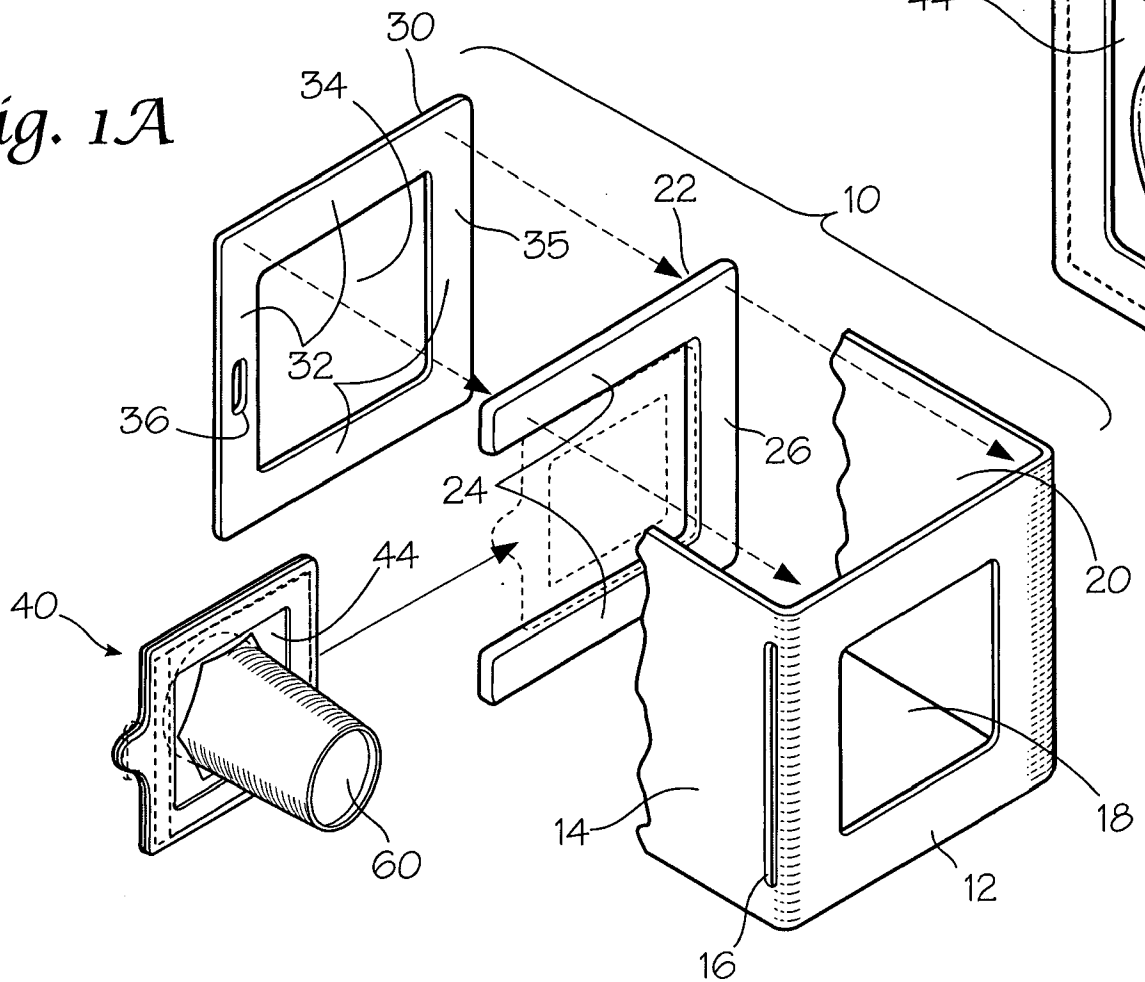

FIG. 1A provides an exploded view of one embodiment of a front piece and a cup-dispensing insert of present invention. The front piece, 10, of FIG. 1 is comprised of a cup dispenser face, 12, which comprises a first side wall, 14, sized to contain a cup-dispensing insert access port, 16. The cup dispenser face, 12, also comprises a prominent hole, or void, 18, to provide for the passage of cups. Typically for aesthetics, but not necessarily, an opposing side wall, 20, is sized and contoured to match the first side wall, 14. A gasket-centering "U", 22, is glued or otherwise attached to the inside of the cup dispenser face, 12, and is a component of the front piece, 10. The gasket-centering "U", 22, is aligned so as to be in the same plane as the access port, 16, and opposing guides, 24, of the gasket-centering "U", 22, are spaced to provide sufficient space for the reversible entry and removal of a cup-dispensing insert, 40. An end leg, 26, comprises the structure that joins the two opposing guides, 24, and in this embodiment is configured to limit undesired forward movement of the cup-dispensing insert, 40.

A gasket locking plate, 30, comprises four sides, 32, a prominent hole, or void, 34, to provide for the passage of cups, and a keeper slot, 36, positioned and sized to reversibly receive a locking button, 42 (observable in FIG. 1B), that is integral with and located on the cup-dispensing insert, 40. The gasket locking plate, 30, is glued or otherwise attached to the gasket-centering "U", 22, and is a component of the front piece, 10. The gasket locking plate, 30, is aligned so that its keeper slot, 36, is positioned in the front piece, 10, to receive the locking button, 42, of the cup-dispensing insert, 40. This provides a reversible securing mechanism that keeps the cup-dispensing insert, 40, in proper position during repeated use, but that also provides for ready and easy removal of the cup-dispensing insert, 40, such as for cleaning, maintenance, repair, change-out, and the like. As discussed below, this is but one means to secure the cup-dispensing insert, 40, in its operational position in the front piece, 10.

Figures 1C, 2A:
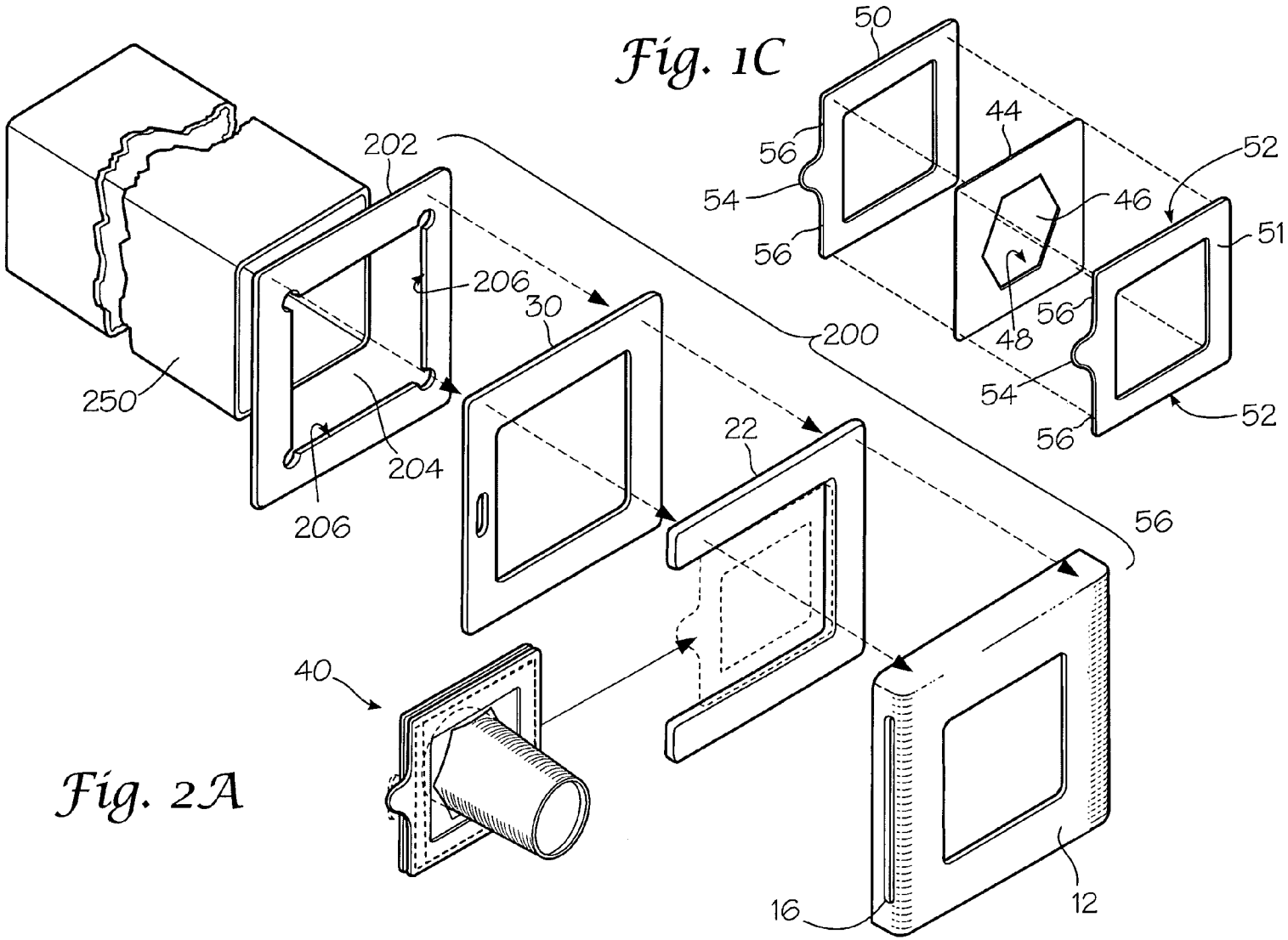
FIGS. 2A–C provide an exploded and perspective views of the embodiment of FIG. 1, and additionally provides a flange, or collar, as an additional component of the front piece of FIG. 1, and a cup housing for attachment to the front piece.

As to the cup-dispensing insert, 40, details of which are more clearly seen in FIGS. 1B and 1C, this is comprised of a flexible gasket, 44, which contains a centrally-positioned hole, or void, 46, that typically is specifically sized for a particular size of cup for easy and reliable dispensing. In FIGS. 1A and 1B, a cup, 60, is shown in dispensing position held frictionally and compressively in contact with the edges, 48, of the flexible gasket, 44, where those edges, 48, form the hole, or opening, 46, in the flexible gasket, 44. The cup-dispensing insert, 40, also is comprised of two frames, 50 and 51, both of whose opposing edges, 52, are parallel and are sized to slidably enter the space, or slot, defined in part by two opposing guides, 24, of the gasket-centering "U", 22, by the access port, 16, the inner face of the cup dispenser face, 12, and the forward face, 35, of gasket locking plate, 30. A locking button, 42, is positioned on an extension, 54, of the outer edge, 56, of one frame, 50. Both frames, 50 and 51, have extensions, 54, and these extensions are used for gripping by a person who is sliding the cup-dispensing insert, 40, into or out of the access port, 16, of front piece, 10, to help facilitate such action. As depicted in FIG. 1C, in this embodiment the cup-dispensing insert, 40, is assembled by sandwiching the flexible gasket, 44, between the two frames, 50 and 51, which are here shown as matching. Once in proper orientation, these components are then sewn together with nylon thread, such as in the pattern indicated in FIG. 1B.

In one particular version of the embodiment shown in FIG. 1A–C, the flexible gasket, 44, is composed of flexible food grade silicon gasket material, and is 0.062 inches in nominal thickness. The frames, 50 and 51, are composed of relatively more rigid polycarbonate plastic that has a nominal thickness of 0.030 inches. In one particular version of the embodiment shown in FIG. 1A–C, the cup dispenser face, 12, the gasket-centering "U", and the gasket locking plate, 30, are made of acrylic type plastic, and have, respectively, nominal thicknesses of 0.187, 0.220, and 0.187 inches. Other types and thicknesses of plastics and gasket material are envisioned, and are within the scope of the present invention.

Further, in describing how the above or other components described herein are attached, it is noted that components not only may be glued or otherwise adhered together by an adhesive, such as but not limited to caulk, but alternatively can be secured together by attachment devices such as screws, nails, rivets, staples, magnets, hooks, clamps, lugs, pins or other mechanical linking or couplings, any type of fastener, any type of connector, or any other suitable conventional attachment mechanism, system or device. Collectively, these means of attaching, or means of securing, may be referred to herein as "otherwise attached."

To assemble this embodiment of the present invention for use in cup dispensing, the cup-dispensing insert, 40, is slid into the cup-dispensing insert access port, 16. Near or at the end of inward travel of the cup-dispensing insert, 40, the locking button, 42, meets, depresses into, and thereby reversibly engages the keeper slot, 36. It is noted that in certain embodiments, the specifications, component thicknesses, and the space tolerances are such that the gasket locking plate, 30, noticeably deforms away from and due to the insertion of the locking button, 42, whilst the locking button, 42, is being slid toward or away from the keeper slot, 36. In other embodiments, the front face, 12, alternately may deform whilst positioning or removing the cup-dispensing insert, 40, where the latter comprises a locking button, 42, as its securing means.

Also, it is noted that in certain embodiments the length of the extensions, 54, in relation to the force required to pull the cup-dispensing insert, 40, from its position in the front piece, 10, are such that one of ordinary strength cannot readily only use digitally applied force on these extensions, 54, to free the locking button, 42, from the keeper slot, 36, and thereby pull out the cup-dispensing insert. This is so that an unauthorized person, such as a mischievous customer, will not readily be able to disassemble this component. Rather, for such embodiment, the typical and recommended manner to remove the cup-dispensing insert, 40, from its position in the front piece, 10, is to pull the locking button, 42, forward (i.e., away from the keeper slot, 36) and at the same time, with the other hand, grip the gasket, 44, within its void, 46, and apply lateral force on the gasket, 44, to slide the cup-dispensing insert, 40, out of the side access port, 16. This combined effort requires that the cups are removed, and this is something that may discourage most if not all mischievous customers.

The above two components, the front piece, 10, and the cup-dispensing insert, 40, comprise a functional subcombination (i.e., an assembly) that is employed in a number of cup dispenser assembly configurations described below. The operation of this subcombination is more readily understood where it is assembled onto, or is integral with, other components of a cup dispenser. Essentially, during typical operation, a nested stack of cups is stored in a cup housing, or sleeve, positioned behind the subcombination. This cup housing, or sleeve, holds cups corresponding in size to the opening, 46, of the gasket, 44. To initially load the apparatus with cups, the cups are pushed inward through the aligned holes or voids, 18, 44, and 34. Thereafter, a user in need of a cup from this cup dispenser apparatus pulls the exposed first cup with sufficient force to overcome the friction and compressive forces being applied on that cup by the edges of the silicone gasket, 44, thereby releasing the cup for use to that user.

As to specifics of the flexible gasket, 44, a hexagonal shape for the hole, or void therein, 46, is considered easier and overall superior than other shapes of such hole or void. Generally, the dimensions of a hole or void in a silicon gasket and the corresponding cup sizes are shown in Table 1.

TABLE 1

Examples of dimensions of hexagonal hole, or void, in Flexible Gasket, 44, to accommodate disposable cups of various sizes

| Size Designation | Widest cross-sectional width of hexagon[1] | Nominal cup size (diameter at lip) that fits this size |
|---|---|---|
| Small | 3 1/16 inches | 3 3/8 to 3 15/16 inch |
| Medium | 3 3/8 inches | 3 5/8 to 4 1/8 inch |
| Large | 3 7/8 inches | 4 1/8 to 4 3/4 inch |

Note 1:
These measurements are taken at the rounded corners of the respective hexagon. The true diameter of the circle defining the edges of each hexagon is slightly larger.

It is further noted that for cups that are in the range between one hexagon size and the next, the characteristics of the particular cup will contribute to the determination of the correct size for that particular cup. For instance, whether a cup is plastic or foam, and its relative flexibility, durability and friction characteristics, will affect such determination. Also, the above sizes cover the range of cup volume from about 12 ounces to include at least some cups that hold 64 ounces. Smaller and large gasket holes are readily constructed, and expand the cup volume range from about 8 ounce cups to 64 ounce cups (i.e., a wider opening that will accommodate more varieties of 64 ounce cups).

The front piece of the present invention may be manufactured and assembled to be integral with a cup dispenser or may be separately manufactured and later assembled to form a cup-dispensing unit. FIG. 2A provides one example of embodiments and aspects in which the functional subcombination (i.e., an assembly) is utilized by assembling with other components to form a functional, complete, cup dispenser. FIG. 2A shows the same components of the front piece, 10, as shown in FIG. 1. In addition to these components, the front piece, 10, also comprises a cup housing lock flange, 202. The cup housing lock flange, 202, has an opening, 204, that is shaped and sized to receive the front of a matching cup housing, 250. When the cup housing lock flange, 202, is glued onto or otherwise attached with the other described components of the front piece, 10, as shown in FIG. 1, this front piece assembly is designated as flange-fitted front piece, 200. In the embodiment of FIG. 2A, the inward faces, 206, of the cup housing lock flange, 202, that define the opening, 204, matingly receive the outside front edge of the matching cup housing, 250. In one embodiment, the thickness of the inward faces, 206, is 0.187 inches, and the cup housing lock flange, 202, is made of acrylic plastic.

Using such components, one way to assemble the cup housing, 250, with the flange-fitted front piece, 200, is to apply suitable plastic glue or solvent to the inward faces, 206, and/or to the front 0.200 inches or so of the outside front edge of the matching cup housing, 250. Then the front edge of the matching cup housing, 250, is slid into the opening, 204, thereby contacting the inward faces, 206. In the preferred embodiment, at least a portion of the back-facing surface of the gasket locking plate, 30, acts as a stop or a keeper for proper alignment of the matching cup housing, 250, with the flange-fitted front piece, 200. After suitable time for drying and curing of this joining step, the cup-dispensing assembly is ready for use (of course, with the spring or other selected mechanism to provide cup-advancing force, and other needed ordinary and/or described components installed). In the embodiment depicted in FIG. 2A, the side, top and bottom walls of cup front face, 12, extend only just past the depth required by the total thicknesses of the front wall of the cup dispenser face, 12, the gasket-centering "U", and the gasket locking plate, 30. This provides for mounting of the flange-fitted front piece, 200, into a cabinet or counter. For instance, after assembly with the cup housing at a store where a soda counter is being constructed, the flange-fitted front piece, 200, can be screwed into a vertical wall of a cabinet or into the horizontal countertop. Alternately the flange-fitted front piece, 200, can be otherwise attached as that term has been defined herein.

In other variations of the invention in which the front piece of a front piece/cup-dispensing insert assembly is, when manufactured, not integral with the cup housing, the flange can extend backward to surround the front of the cup housing, in the manner of a typical pipe flange. Various means of permanent or non-permanent attachment may be effectuated to join or reversibly join the cup housing with the front piece. That is, components not only may be glued or otherwise adhered together by an adhesive, but alternatively can be secured together by attachment devices such as screws, nails, rivets, staples, magnets, hooks, clamps, lugs, pins or other mechanical linking or couplings, any type of fastener, any type of connector, or any other suitable conventional attachment mechanism, system or device.

Figures 2B, 2C:
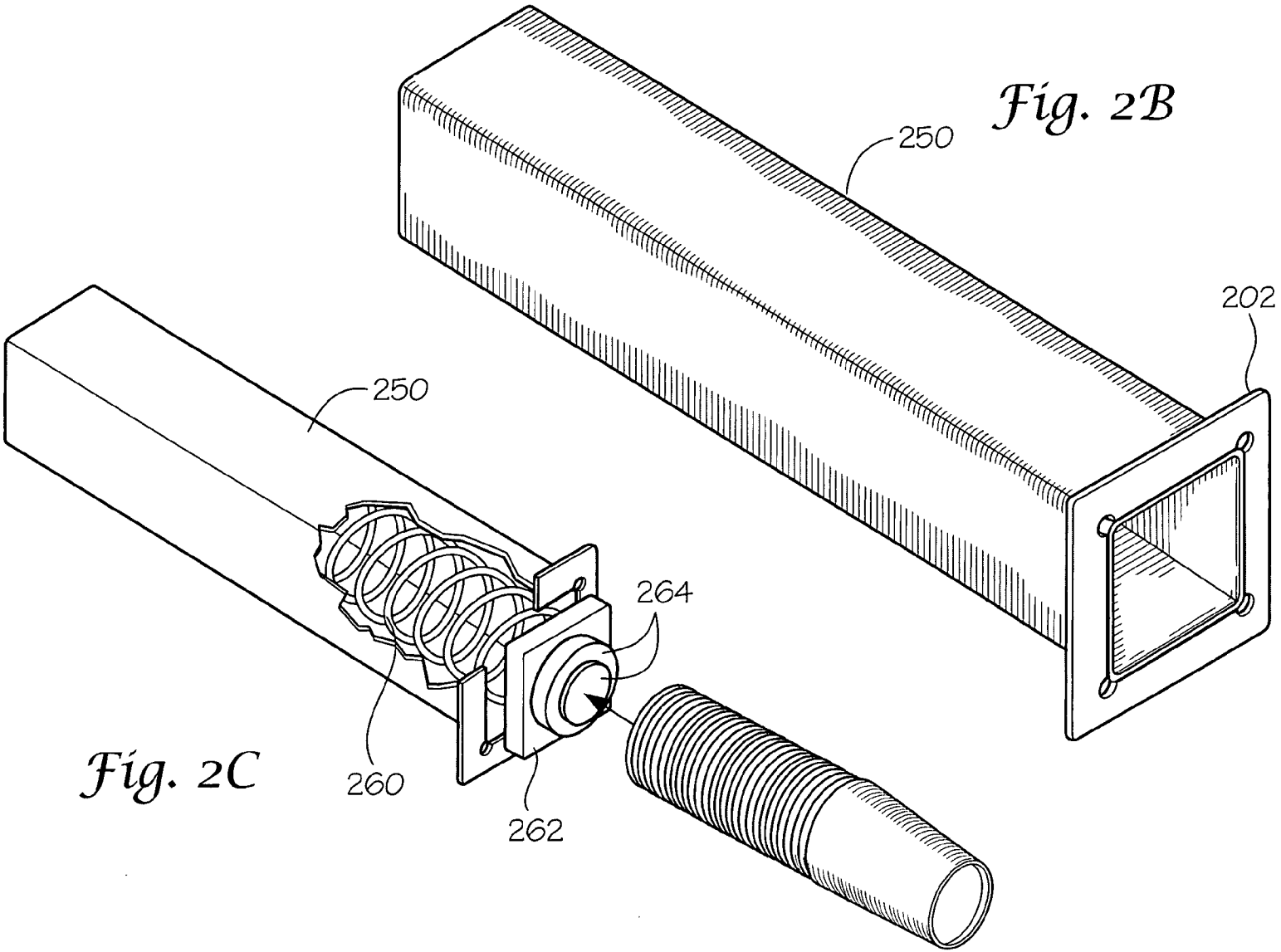

FIG. 2B depicts another variation of how the side accessed front piece/cup-dispensing insert assembly subcombination of the present invention may be assembled with a cup receptacle or cup housing. FIG. 2B shows the cup housing lock flange, 202, secured to the cup housing, 250. Here, where these two components are assembled prior to assembly of the cup housing lock flange, 202, to any component of the front piece (i.e., the gasket locking plate, 30), this two-component assembly is thereafter glued, screwed, or otherwise attached to the front piece. This is but one of many alternatives for assembly of components of cup-dispensing units that utilize and incorporate the front piece/cup-dispensing insert assembly subcombination of the present invention.

Also, FIGS. 2A and 2B are in no way meant to limit the shape of the flange and the matching cup housing. For instance, but not meant to be limiting, a round cup housing is common, and a flange with corresponding and matching round receiving structure is within the scope of the present invention. Whatever the shape of the receptacle storing the stacked cups, and whatever means are used to attach such receptacle to the front piece, the cup assembly so formed typically contains the helical spring and cup retainer that are shown in the following figure, FIG. 2C. These provide and transmit a cup-advancing force, as that term is used herein, against the stack of cups held for dispensing.

FIG. 2C provides a perspective view that includes a cut-away section to show the internal helical spring and stacked cups. Here, a helical spring, 260, spans the length of the cup housing, 250, and is sized to provide a suitable degree of cup-advancing force across a relatively wide range of loading of stacked cups. At the forward end of the spring, 260, is a cup retainer, 262, that slides within the cup housing, 250, and that accommodates several cup sizes by virtue of concentrically arranged circular ridges, 264.

Figure 3:
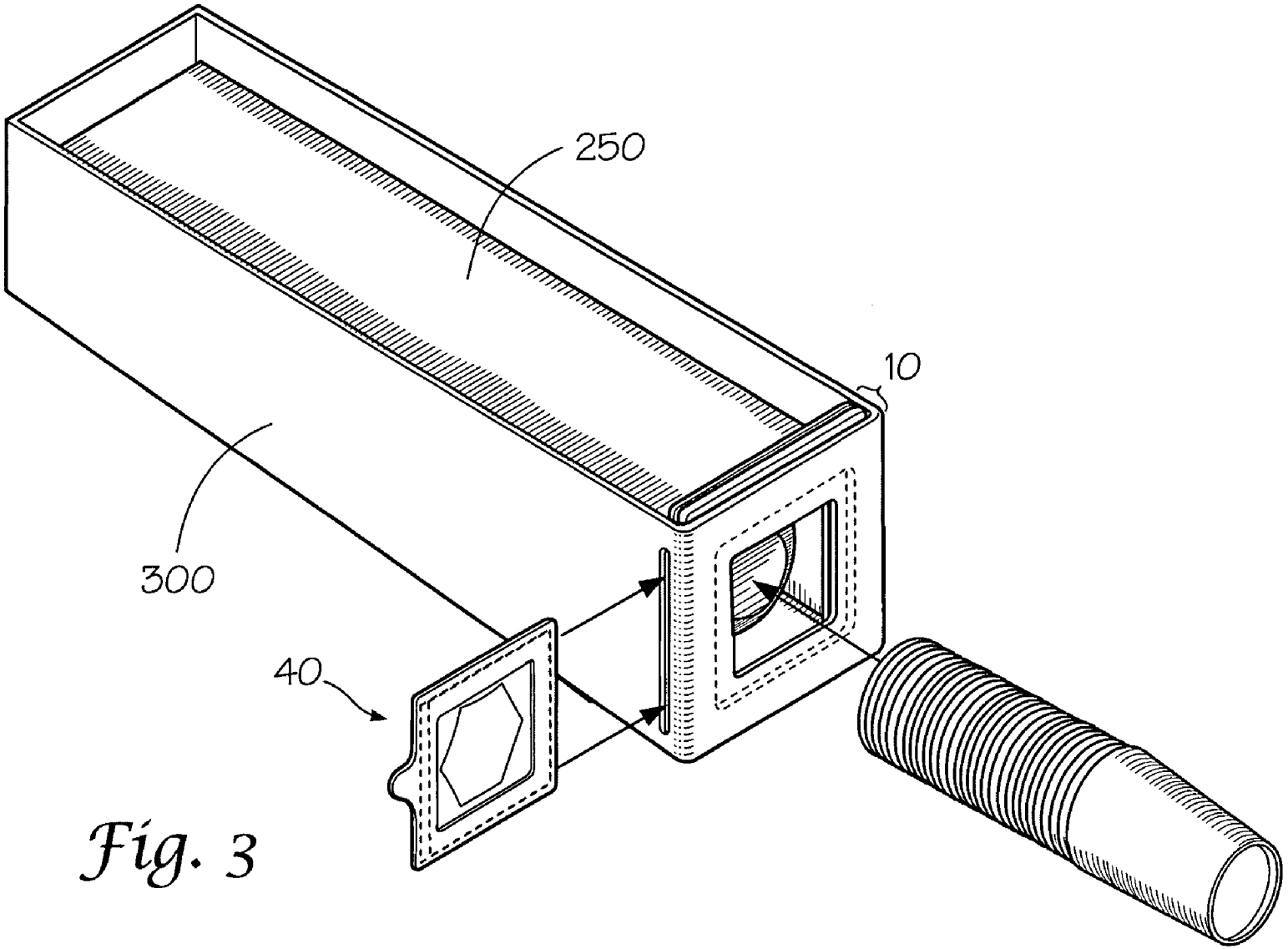
FIG. 3 provides a perspective view of an embodiment of the present invention in which the front assembly is integral with the parts of the cup dispenser that hold the stacked cups.

FIG. 3 provides a perspective view of an embodiment of the present invention in which the front assembly is manufactured to be integral with the parts of the cup dispenser that holds the stacked cups. Here, the cup housing, 250, is positioned within a cup dispensing body, 300. Any number of means may used to attach the cup housing, 250, to the front piece, 10. Although not depicted in FIG. 3, two aspects of such integral cup dispensers are noted. First, the cup housing, 250, alternatively is fabricated and sized so that its width is considerably (i.e., at least ½ inch) less than the interior span of the cup dispensing body, 300. Second, at the back end of the cup housing, 250, one or more bracing pieces, similar to the cup housing lock flange, 202, of FIG. 2A, are employed to retain and secure the back end of the cup housing, 250, to inside back wall of the cup dispensing body, 300.

Figure 4B:
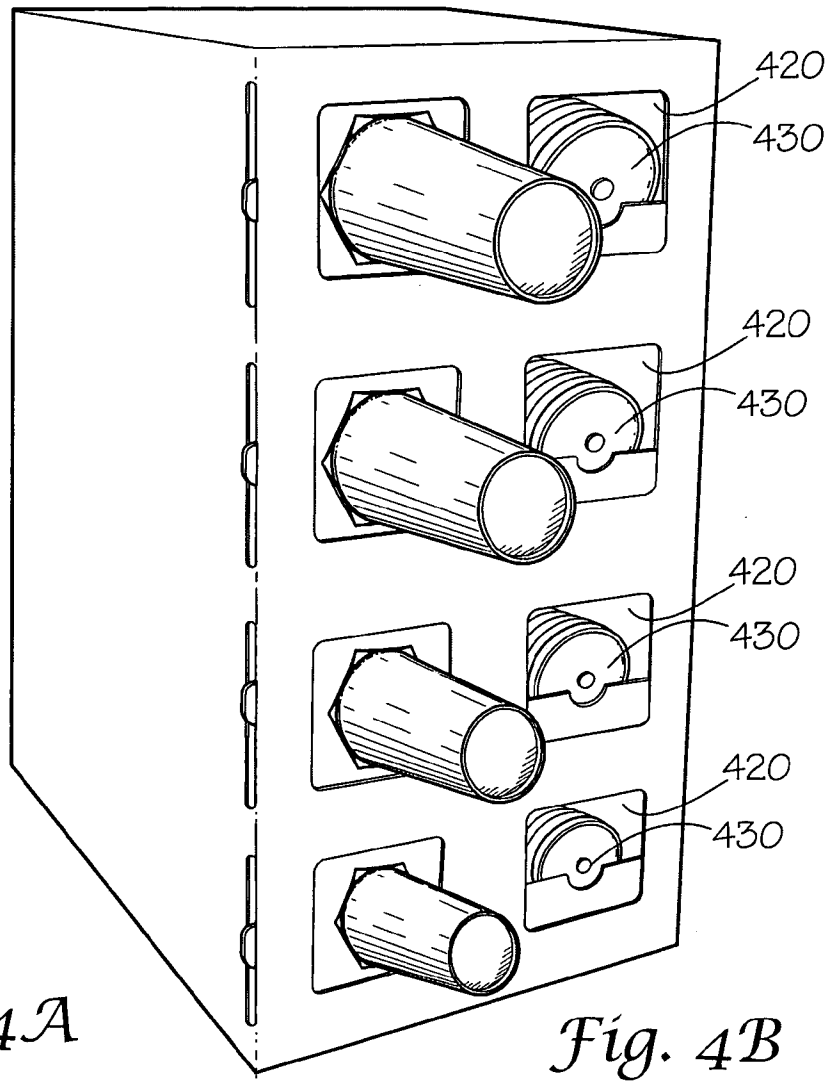
FIG. 4 provides a perspective view of an embodiment of the present invention in which multiple integral cup dispensers are provided as a single unit.
Figure 4A:
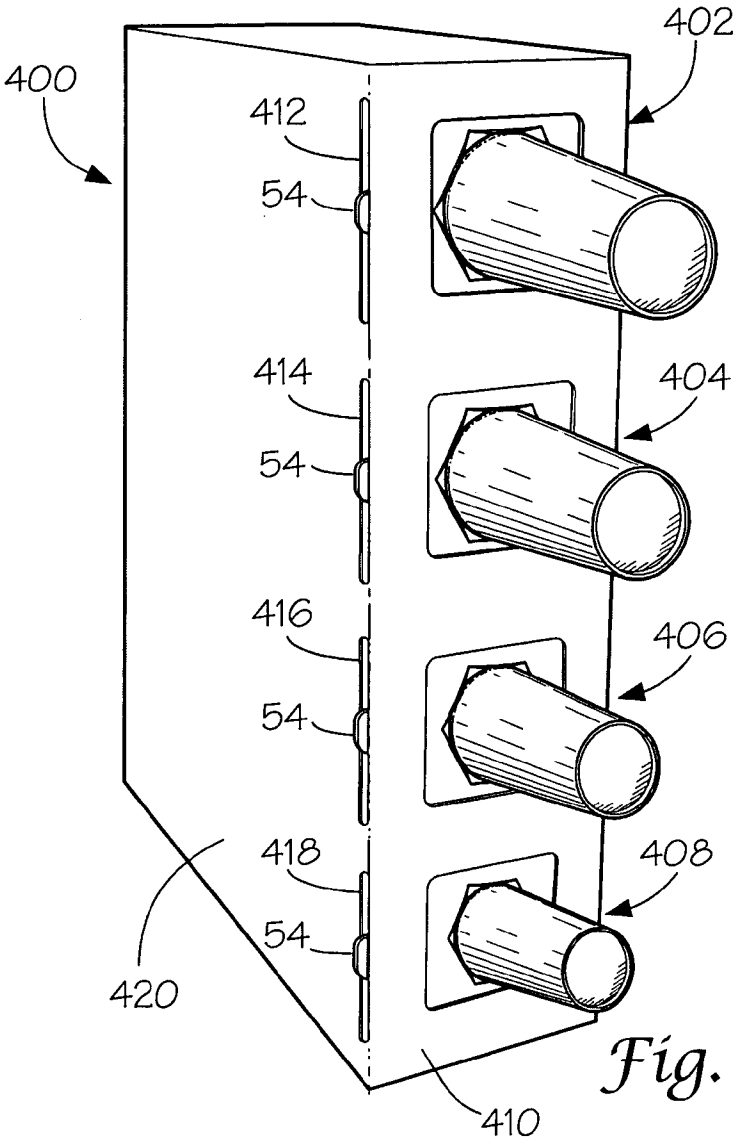

FIG. 4A provides a perspective view of an embodiment of the present invention in which multiple cup dispensers are provided as a single unit. Four cup dispensers, 402, 404, 406 and 408 of the present invention are arranged in a single multi-cup dispensing unit, 400, with a single front face, 410, having an aesthetic value of simplicity and a less complicated view. Nonetheless, the features of the front piece/cup-dispensing insert are found in this unit. Side access ports, 412, 414, 416, and 418, are longitudinal, vertical slots in the side, 420, of the single assembly, 400. The ends of the respective extensions, 54, of the frames, 50 and 51, are shown extending slightly from the respective access ports.

FIG. 4B provides a perspective view of an embodiment of the present invention in which four cup dispensers are provided as a single unit. This is very similar in construction to the embodiment in FIG. 4A, however, to provide for easier use of the cups, bins with open fronts, 420, are provided for storing and dispensing lids for the cups. These are arranged advantageously to provide the correct size of lid, 430, for the cup to its left side.

Figure 5:
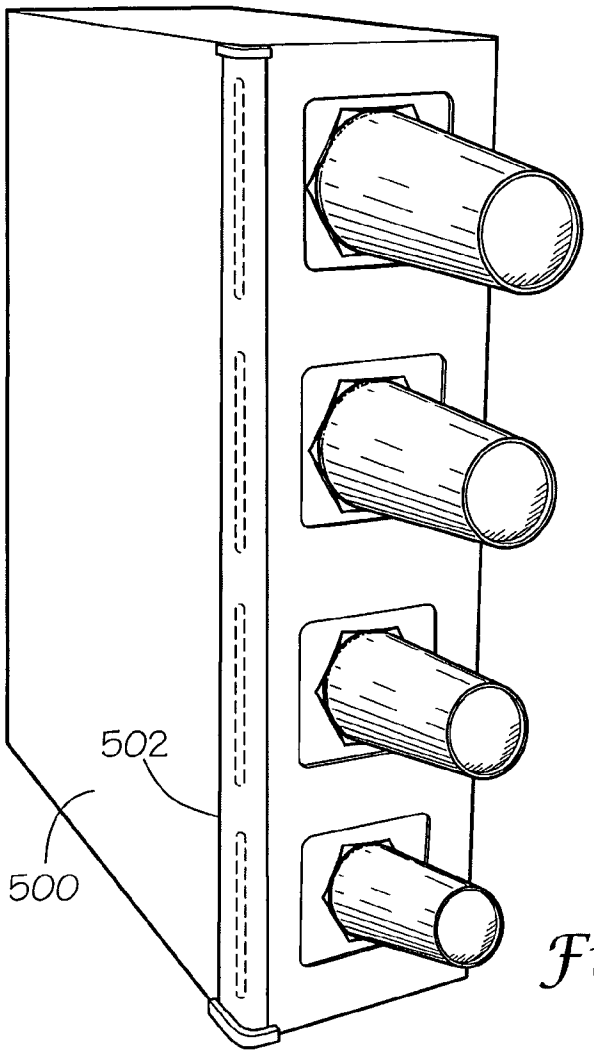
FIG. 5 provides an example of an alternative securing means for the cup-dispensing inserts, in a perspective view of an embodiment of the present invention in which four cup dispensers are provided as a single unit.

FIG. 5 provides a perspective view of an alternative embodiment that uses a different approach to securing and retaining the cup-dispensing insert of the present invention. Here, in a four-unit integral cup dispenser, 500, a corner cover piece, 502, is designed to cover the four access ports, 16 (shown as hidden here, observable in FIG. 4A).

Figure 6B:
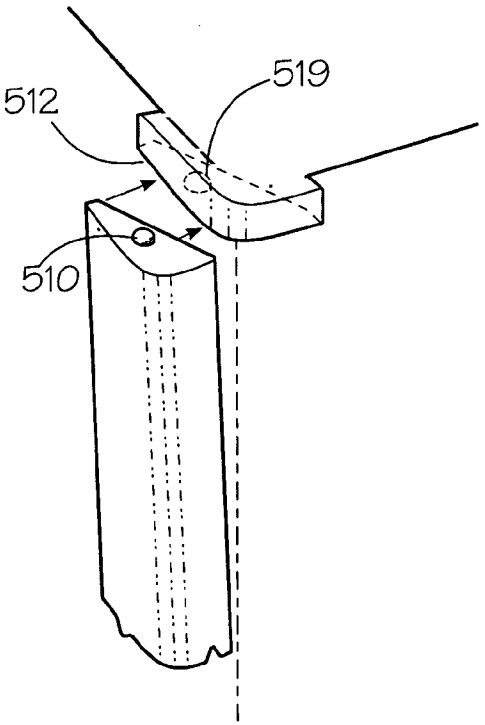
FIGS. 6A and 6B provide enlarged perspective views of the bottom and top areas, respectively, of the corner in FIG. 5 that comprises the alternative securing means for the cup-dispensing inserts.
Figure 6A:
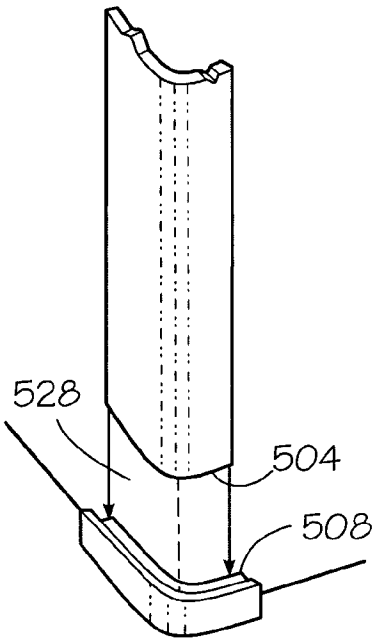

FIGS. 6A and 6B provide enlarged perspective views of the bottom and top areas, respectively, of the corner in FIG. 5 that comprises the alternative securing means for the cup-dispensing inserts. As depicted in FIG. 6A, for the embodiment shown in FIG. 5, an end lip, 504, at the bottom end of the corner cover piece, 502, inserts into a slot, 506, at the bottom of the aperture, 508, into which the corner cover piece, 502, is placed. As to the top end of the corner cover piece, 502, as seen in FIG. 6B, the corner cover piece, 502, is then elevated and fully inserted into the aperture, 508, and snaps into a stationary position by means of a knob, 510, pressuring against a retaining structure, 512, and reaching a cavity, 519, which accommodates the knob, 510.

When so positioned, the corner cover piece, 502, covers the four access ports. This is desired in certain embodiments. The mechanism for retaining the corner cover piece, 502, in its stationary position, may be any means known in the art for reversible connection or attachment. This can include, but is not limited to, hinges, screws, nails, rivets, staples, magnets, hooks, clamps, lugs, pins or other mechanical linking or couplings, any type of fastener, any type of connector, or any other suitable conventional attachment mechanism, system or device that permits periodic opening of the corner cover piece, 502.

Here also, in particular versions of this embodiment, the four cup-dispensing inserts need not have the extensions, 54, of the outer edges, 56, of frames 50 and 51, nor anything analogous to this. Nor are the locking button, 42, or the keeper slot, 36, nor anything analogous to these, needed. For instance, the dimensions of the space receiving the cup-dispensing insert within the side access port, 16, and the dimensions of the cup-dispensing insert, are coordinated so that upon closure of the corner cover piece, 502, the cup-dispensing insert(s) is/are retained snugly within the space. Also, extending the discussion of alternatives to certain details in the embodiments described in FIGS. 1 and 2, it is noted that there are numerous alternative means to secure the cup-dispensing insert in its operational position. For instance, not to be limiting, any number of indents may be machined along the top edge of the bottom opposing guide (refer, for instance, to FIG. 1 to identify "24"), and corresponding, matching extensions, tabs, or teats may be provided along the bottom edge of the cup-dispensing insert. A corresponding greater height tolerance is needed in the space into which the cup-dispensing insert travels. However, then the cup-dispensing insert, once slid into place, falls into one or more designed indents, and the designed corresponding extensions, tabs, or teats retain the cup-dispensing insert in its operational position. In such embodiments, the extensions, 54, of the outer edges, 56, of frames 50 and 51, may advantageously be enlarged or eliminated, depending on preferences, design objectives, and design specifics.

Also, extending the discussion of alternatives to certain details in the embodiments described in FIGS. 1 and 2, it is noted that there are numerous alternative means to handle and manipulate the cup-dispensing insert into and from its operational position. These in many embodiments will depend on the design of the means for securing the cup-dispensing insert in its operational position.

Likewise, it is recognized that the dimensions of the side access port may be varied to accommodate the shape and dimensions of the cup-dispensing insert, or vice versa. For instance, and not to be limiting, a user may want a sufficiently wide slot into which the cup-dispensing insert travels, in order to be able to more easily clean this space. In such case the access port and the slot into which the cup-dispensing insert travels are made wide, and the insert itself is also widened as and where needed to conform to this wider slot. Also, is a thicker area of the cup-dispensing insert is designed and produced, such as the area surrounding the hole of the gasket, then the access port is correspondingly altered to accommodate this design.

Also, it is recognized that the existence or non-existence of a gap along the bottom edge of the slot formed in the front piece, to receive the cup-dispensing insert, is a decision made with cleaning in mind. For instance, with regard to the embodiment depicted in FIG. 1, when the end of the bottom opposing guide, 24, of the gasket-centering "U", 22, that is directed toward the access port, 16, abuts the inside of the side wall below the access port, 16, this junction, when properly glued or sealed (such as by adhesive caulk), provides for a sealed bottom section that can contain any spilled beverages and the like. Alternatively, if it is desired to allow any spillage to drain to a bottom position, a gap at such junction may be provided. It is noted that in most uses of the cup dispensers of the present invention, there is a low likelihood of spillage into the cup dispensing units, so the design specification for this aspect of the design is not of high relative significance. Also, it is noted that the fabrication of the components of the present invention may be achieved by any number of means, for instance, without being limiting, by combining functions of several components described herein into one component. One example is to manufacture a molded front piece rather than machine and assemble the components described above. Another example is to manufacture a single molded piece that satisfies the functions of the gasket-centering "U" and the gasket locking plate. Also, a single molded piece, such as is achievable by co-extrusion injection molding, may be manufactured and used in the present invention. In such process at least two types of plastic are co-injected, with a more rigid, or resilient plastic being injected to the peripheral regions of the mold, and a more pliable, flexible plastic injected to form a central region which will include a hole sized for passage of cups in the cup dispenser apparatus of the present invention.

The present invention is not limited as to the exact mechanical combination that provides the restraining force countering the spring or other cup advancing force, and that also provides the resistive force on the cup to be dispensed, against which a user in need thereof pulls to release that cup. It is generally recognized that the function of such mechanical combinations is to exert a counter force to the cup-advancing force, in a direction to retain the cups within the front piece of the apparatus, thus facilitating the removal of one cup at a time. However, any of a number of alternative mechanisms known and recognized in the art may provide such function without departing from the scope of the present invention. For instance, without being limiting, a cup-retaining means is comprised of:

1. the flexible gasket as shown and assembled in embodiments described in detail herein;
2. a flexible, yet resilient piece of plastic (as opposed to silicone) that is shaped and oriented to contact one or more parts of the outer section of a first cup in the stack of stacked cups;
3. one or more springs, or sections of flexible tubing, such as silicon tubing, that are placed in a plane, or in parallel planes, perpendicular to the axis of the stacked cups, and that encircle that axis and the cups themselves, and are positioned and tensioned such that one or more portions of each of the one or more springs or tubing sections contact one or more parts of the outer section of a first cup in the stack of stacked cups (see, for instance, U.S. Pat. No. 6,398,072, which is incorporated by reference herein);
4. a co-extruded cup-dispensing insert that comprises a plastic in its center with sufficient flexibility to dispense cups, and also with sufficient plastic memory and resilience to provide a desired service life;
5. a flexible metal insert, such as composed of aluminum or an aluminum alloy, that is pinched or otherwise configured to exert pressure against stacked cups; and
6. an elongated, yieldable tension element disposed along the plane of the cup-dispensing insert and astride the open end of a cup to be dispensed, and in transient engagement with the flange of such cup, such as described in U.S. Pat. No. 5,012,952).

It is recognized that the cup-retaining means exerts a cup retaining force upon the cups it retains and dispenses, and that in practice such cup retaining force is balanced, by trial and error by one of ordinary skill in the art, with the cup advancing force of the cup advancing means, i.e., a helical spring positioned within said cup housing, gravity, or the like.

While a number of embodiments of the present invention have been shown and described herein, it is apparent that such embodiments are provided by way of example only. Numerous variations, changes and substitutions will occur to those of ordinary skill in the art without departing from the invention herein. Accordingly, it is intended that the invention be limited only by the spirit and scope of the appended claims.

We claim:

1. A side-accessed front piece for a cup dispensing unit, comprising:

a. a rigid front face comprising a centrally positioned hole through which cups of a desired size may pass;

b. one or more side walls contiguous with said front face, and extending for a distance backward from said front face;

c. an access port positioned on one of said one or more side walls; and d. one or more generally planar components, comprising voids sized and positioned to permit axial passage of said cups, positioned behind said front face to guide and retain a cup-dispensing insert that is sized to enter laterally said access port, and that comprises elements that retain and dispense cups from said cup dispensing unit.

2. A cup-dispensing insert for use in a side-accessed front piece for a cup dispensing unit, comprising:

a. a rigid frame comprising a perimeter sized to enter an access port of the side-accessed front piece; and b. a cup retaining means to retain and dispense cups from said cup dispensing unit;

wherein said rigid frame is comprised of two matching pieces of polycarbonate plastic that form a perimeter, wherein said two matching pieces sandwich the cup retaining means comprising a flexible silicone gasket material spanning the interior area of said frame and comprising a centrally positioned hole sized to bear against the edges of cups of a desired size, and wherein said two matching pieces and said flexible silicone gasket material are attached together by stitching with nylon thread.

3. The cup-dispensing insert of claim 2, wherein the centrally positioned hole of the flexible silicone gasket material is hexagonal.

4. A side-accessed cup-dispensing assembly, comprising:

a. a side-accessed front piece for a cup dispensing unit, comprising:

1. a rigid front face comprising a centrally positioned hole through which cups of a desired size may pass;
2. one or more side walls contiguous with said front face, and extending for a distance backward from said front face;
3. an access port positioned on one of said one or more side walls; and
4. one or more generally planar components, comprising voids sized and positioned to permit axial passage of said cups, positioned behind said front face to guide and retain a cup-dispensing insert that is sized to enter laterally said access port;

b. the cup-dispensing insert for use in the side-accessed front piece for the cup dispensing unit, comprising:

1. a rigid frame comprising a perimeter sized to enter the access port of said side-accessed front piece; and
2. a flexible material spanning the interior area of said frame, and comprising a centrally positioned hole sized to bear against the edges of cups of a desired size;

wherein the flexible material is adapted to retain and dispense said cups from said side-accessed cup dispensing unit.

5. The side-accessed cup-dispensing assembly of claim 4, wherein the centrally positioned hole of the flexible material of the cup-dispensing insert is hexagonal.

6. A cup dispenser for sequentially dispensing cups from a stacked column of cups, comprising:

a. a cup housing having a back end and a front end, having a cross-section of sufficient size to contain said stacked column of cups, having a length adapted to a desired dispensing area and a desired quantity of cups retainable in said cup housing; and having a means to provide a cup-advancing force, the front end having a hole through which cups of a desired size may pass;

b. a linear access port, along the side of said body at said front end; and c. a cup-dispensing insert sized to insert and be retained in said linear access port, and comprising:

1. a frame forming four sides, where two opposing sides of the four sides are sized to enter the access port, and where the frame contains a flexible gasket;
2. said flexible gasket, comprising a hole sufficiently sized to retain and dispense a desired size of cups that are held in stacked fashion within said cup housing.

7. The cup dispenser of claim 6, the hole of the flexible gasket comprising a hexagonal shape.

8. A means for dispensing cups from a cup housing that houses stacked cups, comprising:

a. side-accessed front piece for a cup dispensing unit, comprising:

1. a rigid front face comprising a centrally positioned hole through which cups of a desired size may pass;
2. one or more side walls contiguous with said front face, and extending for a distance backward from said front face;
3. an access port positioned on one of said one or more side walls; and
4. a means to receive and to retain a cup-dispensing insert that is sized to enter laterally said access port; and b. said cup-dispensing insert that comprises a cup retaining means to retain and to dispense cups.

9. The means for dispensing cups of claim 8, additionally comprising a means for attaching said side-accessed front piece to said cup housing.

10. A means for dispensing cups from a cup housing that houses stacked cups, comprising:

a. side-accessed front piece for a cup dispensing unit, comprising:

1. a rigid front face comprising a centrally positioned hole through which cups of a desired size may pass;
2. one or more side walls contiguous with said front face, and extending for a distance backward from said front face;
3. an access port positioned on one of said one or more side walls; and
4. a means to receive and to retain a cup-dispensing insert that is sized to enter laterally said access port; and b. said cup-dispensing insert that comprises a cup retaining means to retain and to dispense cups; wherein said cup retaining means comprises a flexible silicone gasket material sandwiched and sewn between two polycarbonate plastic frames, and comprises a centrally positioned hole sized to provide cup retaining force on cups of a desired size, said cup retaining force balance against the cup advancing force of a helical spring positioned within said cup housing.

11. The means for dispensing cups of claim 10, wherein the centrally positioned hole of the flexible silicone gasket material comprises a hexagonal shape.

* * * * *